US007155848B2

(12) United States Patent
O'Malley et al.

(10) Patent No.: US 7,155,848 B2
(45) Date of Patent: Jan. 2, 2007

(54) APPARATUS FOR A SCROLLING SIGN

(75) Inventors: Bill David O'Malley, Limehouse (CA); Abram Teichroeb Klassen, Ruscom (CA)

(73) Assignee: 501413 Ontario Limited, Etobicoke ( * ) Notice: Subject to any disclaimer, the term of this patent is extended or adjusted under 35 U.S.C. 154(b) by 0 days.

(21) Appl. No.: 10/454,471

(22) Filed: Jun. 5, 2003

(65) Prior Publication Data

US 2004/0244244 A1 Dec. 9, 2004

(51) Int. Cl.
*G09F 11/12* (2006.01)

(52) U.S. Cl. ..... 40/472; 40/524; 40/624

(58) Field of Classification Search ..... 40/472, 40/524, 525, 118, 624, 606.12; 160/85, 86; 242/548.2, 615.4; 254/372; 226/168, 184
See application file for complete search history.

(56) References Cited

U.S. PATENT DOCUMENTS

| | | | | |
|---|---|---|---|---|
| 2,033,130 | A * | 3/1936 | Eitzen | 40/472 |
| 2,819,544 | A * | 1/1958 | Yoshioka | 40/472 |
| 3,002,304 | A * | 10/1961 | Drese et al. | 40/472 |
| 3,754,342 | A * | 8/1973 | Santacroce et al. | 40/477 |
| 3,850,358 | A | 11/1974 | Nettles | |
| 3,902,648 | A | 9/1975 | Keyser | |
| 3,915,449 | A | 10/1975 | Johnson et al. | |
| 3,927,814 | A | 12/1975 | Holm | |
| 3,938,269 | A | 2/1976 | Catteau | |
| 4,162,585 | A | 7/1979 | Decaux | |
| 4,242,297 | A | 12/1980 | Dacey et al. | |
| 4,316,664 | A | 2/1982 | Nishimoto | |
| 4,348,125 | A | 9/1982 | Fujiwara et al. | |
| 4,753,027 | A * | 6/1988 | Dahl | 40/611.05 |
| 4,894,888 | A | 1/1990 | Bassouls | |
| 5,088,219 | A * | 2/1992 | Toraby-Payhan | 404/71 |
| 5,353,534 | A * | 10/1994 | Fassauer et al. | 40/524 |
| 5,529,274 | A | 6/1996 | Anderson et al. | |
| 5,558,297 | A | 9/1996 | Elmore | |
| 5,612,741 | A * | 3/1997 | Loban et al. | 348/383 |
| 5,682,693 | A * | 11/1997 | Visocky et al. | 40/472 |
| 5,755,050 | A | 5/1998 | Aiken | |
| 5,822,899 | A | 10/1998 | Yonenaga | |
| 5,878,474 | A | 3/1999 | Yasnogorodskiy et al. | |
| 5,896,689 | A | 4/1999 | Bassouls et al. | |
| 6,564,487 | B1 | 5/2003 | Bihr et al. | |
| 6,668,473 | B1 * | 12/2003 | Schoening | 40/518 |
| 2001/0010133 | A1 | 8/2001 | Schoening | |
| 2001/0037591 | A1 * | 11/2001 | Nicholson et al. | 40/452 |

FOREIGN PATENT DOCUMENTS

| | | |
|---|---|---|
| DE | 29510670 U1 | 10/1955 |
| DE | 2112786 | 9/1972 |
| DE | 2951067 A1 | 8/1981 |
| DE | 195 00 259 | 7/1996 |
| DE | 195 37 385 | 4/1997 |
| EP | 0931965 A2 | 7/1999 |

(Continued)

*Primary Examiner*—Joanne Silbermann
(74) *Attorney, Agent, or Firm*—Bereskin & Parr

(57) ABSTRACT

A scrolling sign apparatus is disclosed. The apparatus includes a web having a number of signs connected in a loop. The web includes a bead along each longitudinal edge thereof. The apparatus includes a housing which has a window for displaying the signs. The web is wound on a number of rollers located in the housing which advance the web through the window. Each roller has two circumferential grooves located near the ends of the roller. The grooves engage the beads along the edges of the web.

6 Claims, 7 Drawing Sheets

FOREIGN PATENT DOCUMENTS

| | | |
|---|---|---|
| ES | 2 020 478 | 8/1991 |
| FR | 9912424 | 9/1999 |
| FR | 2796747 | 1/2001 |
| GB | 2183776 A | 6/1987 |
| GB | 2304930 | 3/1997 |
| WO | WO 02/067228 | 8/2002 |
| WO | WO 02/077950 | 10/2002 |
| WO | WO 03/046869 | 6/2003 |

* cited by examiner

APPARATUS FOR A SCROLLING SIGN

FIELD OF THE INVENTION

The invention relates to devices for displaying multiple signs, and in particular, to an apparatus for a scrolling sign.

BACKGROUND OF THE INVENTION

Signs, such as advertising billboards, are commonly used by companies to advertise their goods and services. Typically, such advertisements are static signs or posters. Depending on their size, they may be placed on the sides of roadways, on the exterior of buildings, or in any other exterior or interior location, depending on the sign size.

An improvement over static signs is the development of moving or scrolling billboards or signs. These scrolling signs typically include a sign web composed of two or more individual signs, which permit multiple signs to be displayed in a particular location. Each of the individual signs is passed through a viewing area.

One such scrolling sign is disclosed in US Patent Application Publication 2001/0010133 A1 ("Schoening Application"). The Schoening Application discloses a sign web which is moved back and forth by two rollers on either side of a display area. However, the scrolling sign disclosed in the Schoening Application has a number of mechanical disadvantages causing it to be unreliable, particularly in adverse weather conditions and after long periods of continuous use.

Accordingly, there is a need for an improved apparatus for a scrolling sign which is more dependable during long periods of continuous use.

SUMMARY OF THE INVENTION

According to a first embodiment of the invention, an apparatus for scrolling a web is provided. The web comprises a plurality of signs connected in a loop, the web comprising a first bead along a first longitudinal edge thereof. The apparatus comprises:

a housing defining a window for displaying the signs; and a plurality of rollers located in the housing transversely to the web, the web being located on the rollers for advancement thereof through the window; the plurality of rollers defining a first groove therein, the first groove being adapted to engage the first bead.

Preferably, the plurality of rollers are adapted to repeatedly advance each of said plurality of signs through the window by advancing the web in one direction.

According to a second embodiment of the invention, an apparatus for scrolling a web comprising a plurality of signs is provided. The apparatus comprises:

a) a housing, the housing defining a window for displaying the plurality of signs;

b) a plurality of rollers located in the housing, the rollers being adapted for advancing the web through said window;

c) a cover covering said window, the cover being adapted to permit viewing of the web therethrough; the cover and the housing defining an enclosure, the web being located in the enclosure; and d) a pressurizing means for producing an internal pressure in the enclosure, wherein the internal pressure is higher than atmospheric pressure.

Preferably, the pressurizing means is a fan.

According to a third embodiment of the invention, an apparatus for replacing a selected sign on a web with a replacement sign is provided. The web is located in a housing. The apparatus comprises:

a) a first replacement roller adapted for storing the replacement sign;

b) a second replacement roller adapted to receive the selected sign thereon;

wherein the second replacement roller being adapted to move the web to remove the selected sign and to insert the replacement sign.

Preferably, the apparatus further comprises top and bottom access plates. The top and bottom access plates are rotatably connected to a side of the housing, wherein the top and bottom access plates are adapted to receive the first and second replacement rollers therebetween.

According to a fourth embodiment of the invention, a method of replacing a selected sign on a web with a replacement sign is provided. The method comprises:

a) detaching a first side of the selected sign from the web b) fastening the first side of the selected sign to a second replacement roller;

c) fastening a first side of the replacement sign to the web, the replacement sign being located on a first replacement roller;

d) rotating the second replacement roller to store the selected sign thereon and to unroll the replacement sign;

e) detaching a second side of the selected sign from the web to remove the selected sign; and f) attaching a second side of the replacement sign to insert the replacement sign into the web.

According to a fifth embodiment of the invention, an apparatus is provided which comprises:

a) a web comprising a plurality of signs connected in a loop, the web comprising a bead along a first longitudinal edge thereof;

b) a housing, the housing defining a window for displaying the signs;

c) a plurality of rollers located in the housing transversely to the web, the web being located on the rollers for advancement thereof through the window; the plurality of rollers defining a first groove therein, the first groove being adapted to engage the first bead.

DETAILED DESCRIPTION OF THE PREFERRED EMBODIMENTS

Figure 1:
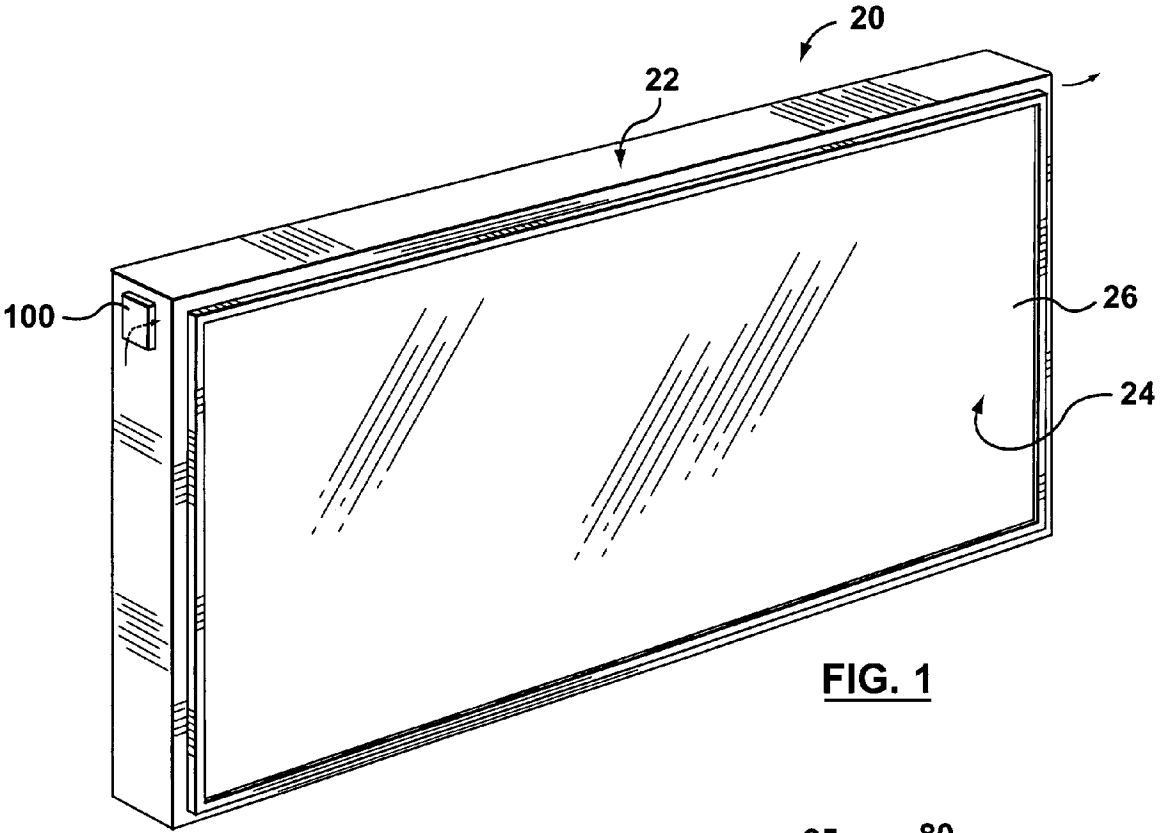
FIG. 1 is a perspective view of the preferred embodiment.

FIG. 1 shows an apparatus 20 for a scrolling sign according to a preferred embodiment of the present invention. Although the preferred embodiment is particularly well suited for horizontal scrolling, it will be understood by those skilled in the art that the present invention is not limited to the horizontal orientation.

Figure 2:
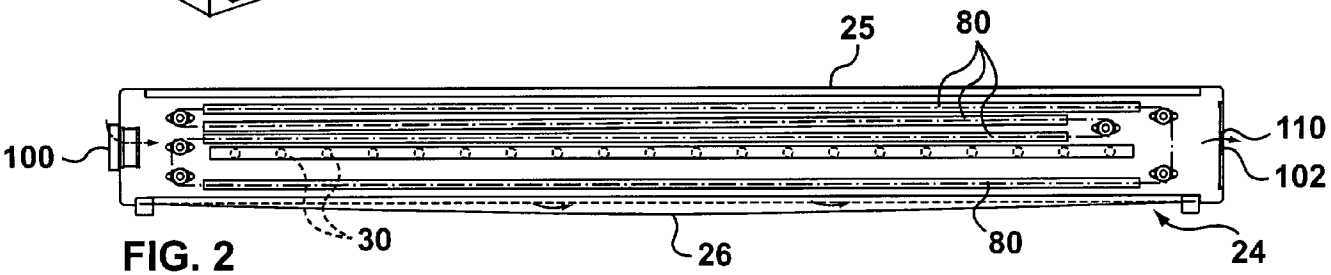
FIG. 2 is a top view of the interior of the housing according to the preferred embodiment.

The apparatus 20 includes a generally rectangular housing 22 having an open front window 24 and a closed rear face 25 (best shown in FIG. 2). The window 24 is covered by a substantially transparent cover 26. Preferably, the cover 26 is made from Plexiglas™. However, it will be understood by those skilled in the art that the cover 26 may be made from any other transparent material.

In an alternative embodiment (not shown), the housing 22 may have a window on both faces thereof for viewing of signs from both sides of the apparatus 20.

Figure 3:
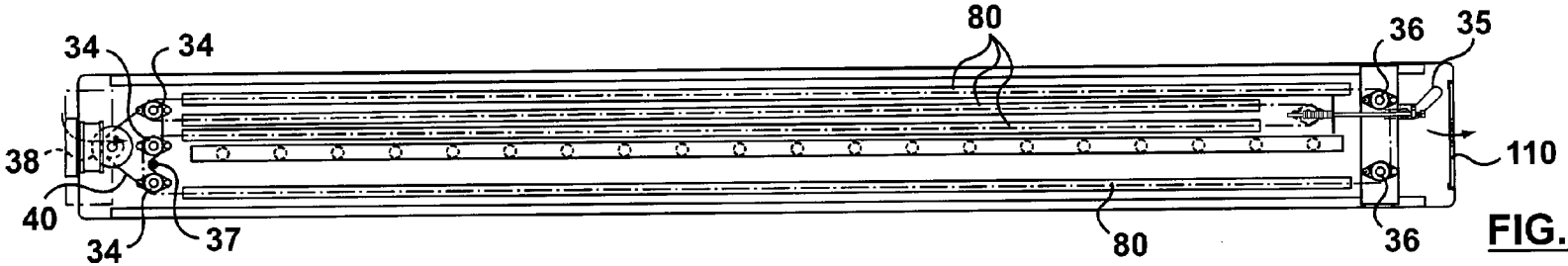
FIG. 3 is a bottom view of the of the interior of the housing according to the preferred embodiment.
Figure 4:
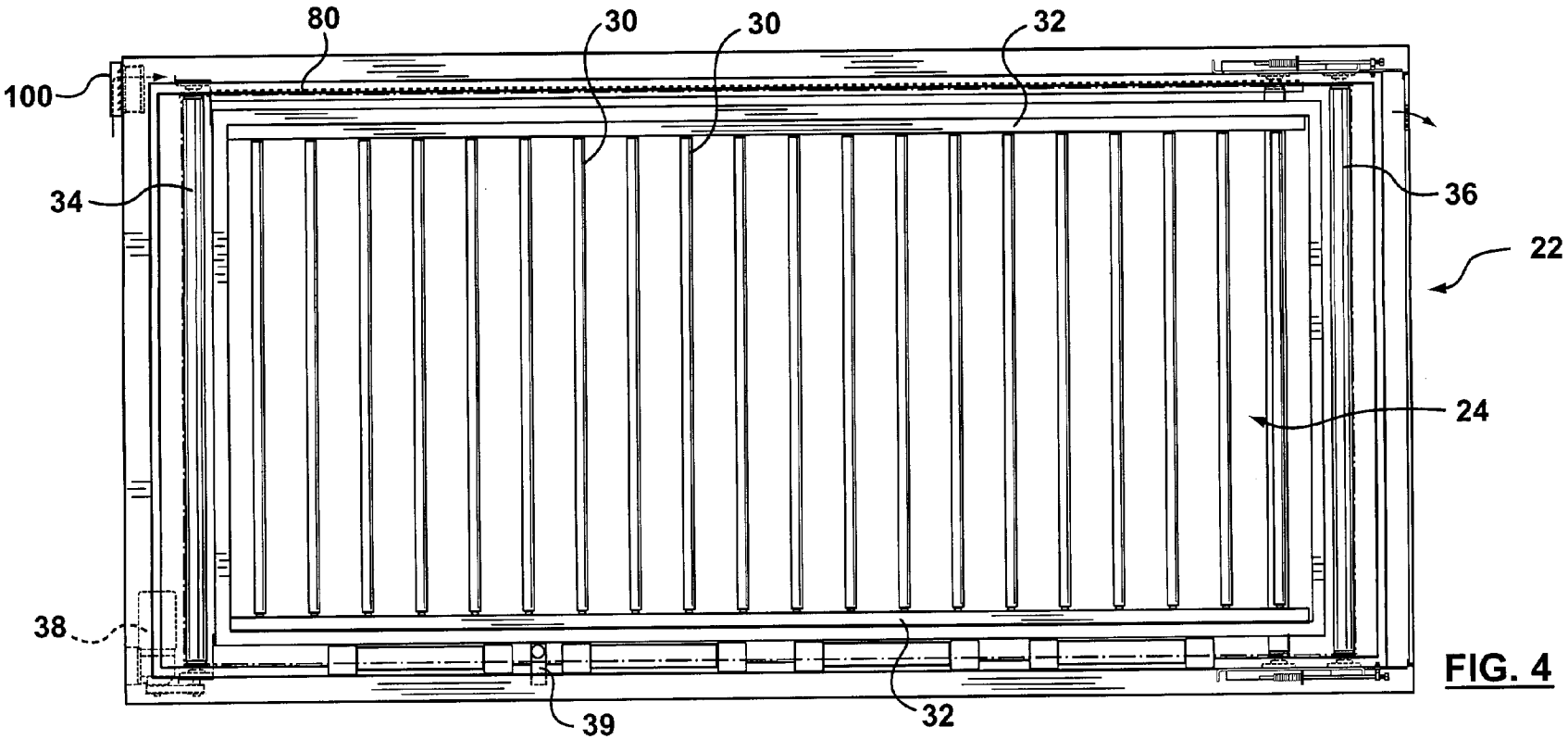
FIG. 4 is a front view of the preferred embodiment.

Referring to FIGS. 2–4, any suitable number of lamps 30 are located in the interior of the housing 22 to illuminate a sign (described in detail below) located in the window. Preferably, the lamps 30, are elongate fluorescent lamps positioned in a substantially parallel arrangement transversely to the direction of travel of a sign web (described in detail below). The lamps are connected to the housing 22 by retaining members 32.

Continuing to refer to FIGS. 2–4, a plurality of rollers 34, 36 are connected to the housing 22 on each side of the window 24. A conventional tension release mechanism 35 is provided to permit fitting of the web onto the rollers 34, 36. A conventional electrical motor 38 drives the rollers 34 on one side of the window 24 by a drive belt 40. An idler 37 engages the drive belt 40 to provide tension therefor. Preferably, a conventional metal detecting sensor 39 is provided to assist in the control of the movement of the sign web. The sensor 39 and the motor 38 are connected to a conventional control system (not shown).

Figure 5:
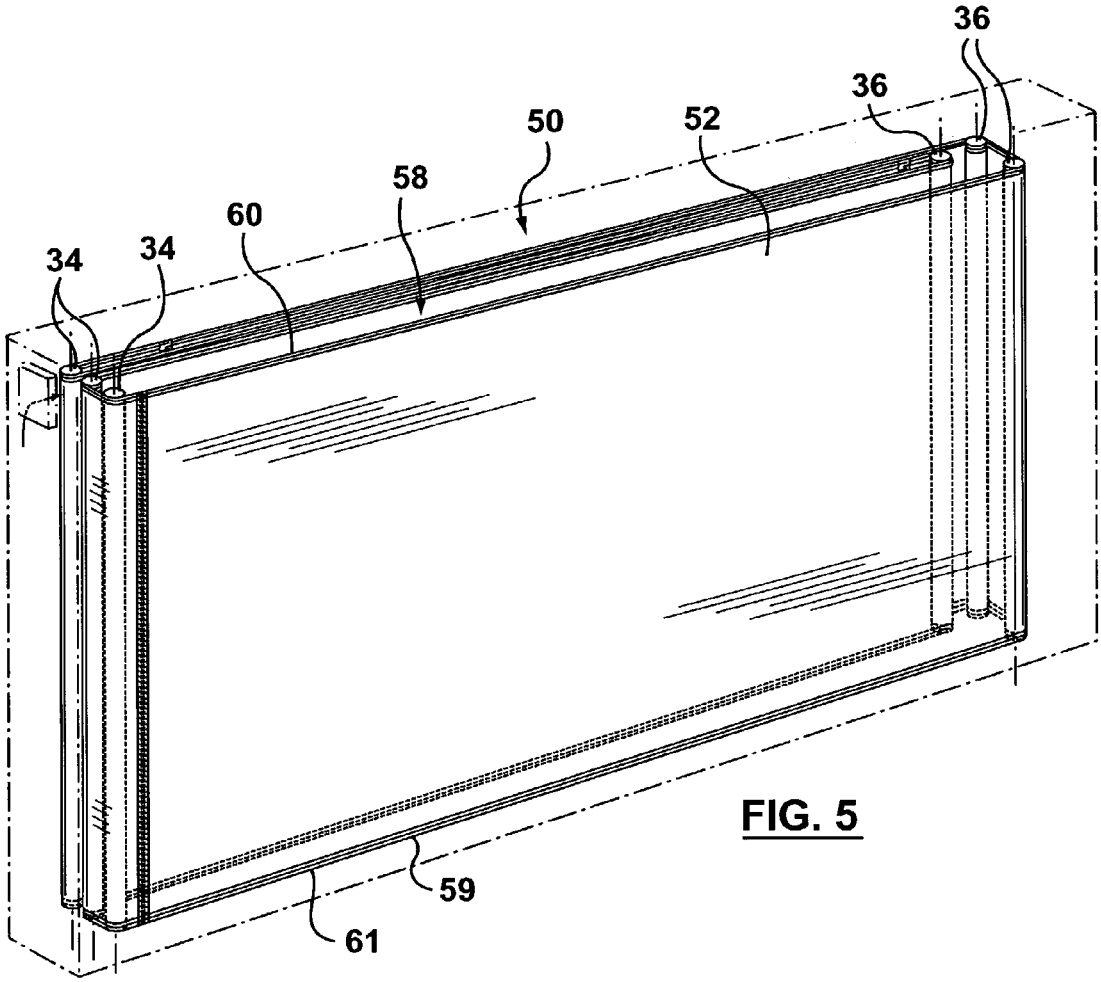
FIG. 5 is a perspective view of the preferred embodiment showing the sign web and rollers.

Referring now to FIG. 5, the rollers 34, 36 of the apparatus 20 scroll a sign web 50 across the window 24. The web 50 is composed of a plurality of signs 52 fastened to each other in a loop. Although the preferred embodiment of the present invention shows the web 50 composed of four signs 52, a web with any suitable number of signs may be accommodated by adding a roller to each side of the window 24, following the arrangement illustrated in FIG. 5. In this manner, the total number of rollers 34, 36 exceeds the number of signs 52 in the web 50 by two (although additional rollers may be added if desired).

Figure 6:
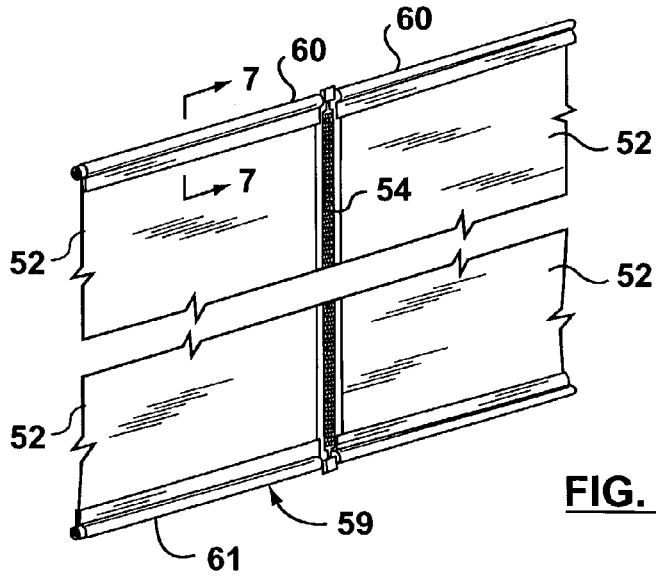
FIG. 6 is a partial perspective view of the preferred embodiment showing the attachment of the signs in the web.

Referring to FIG. 6, the signs 52 are preferably joined to each other by a zipper 54 for easy removal and replacement. It will be understood by those skilled in the art that the signs may be connected to each other in any other suitable fashion.

Figure 7:
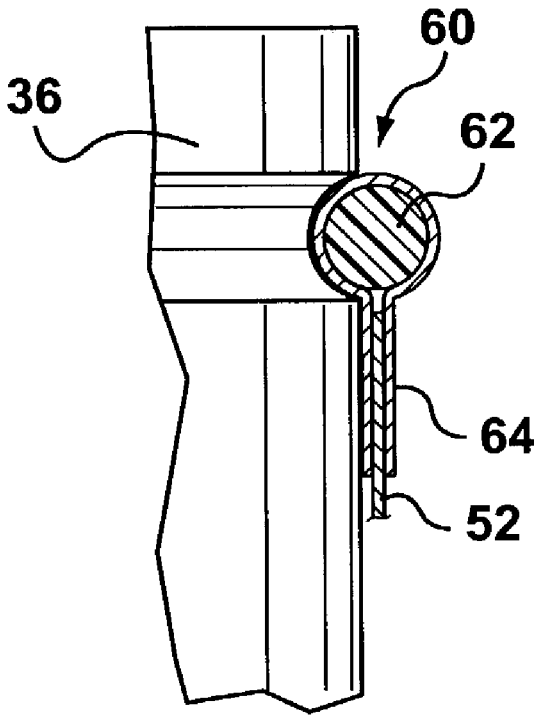
FIG. 7 is a partial cross-sectional view of the preferred embodiment showing the bead on the web.

Referring now to FIGS. 6 and 7, each sign 52 in the web 50 includes a first and second bead 60, 61, connected to a first and second longitudinal edge 58, 59, respectively. As used herein, "longitudinal" means substantially parallel to the direction of travel of the web 50, and "bead" means any type of feature which permits transverse engagement of the web by the apparatus 20 (as discussed in detail below).

As best shown in FIG. 7, the first bead 60 preferably includes an elongate cylindrical member 62 made from a flexible material, such as any suitable plastic or the like. The cylindrical member 62 is preferably wrapped in a fabric 64 and attached to the sign 52 by sewing, welding or the like. The second bead 61 is identical to first bead 60, and accordingly, is not shown. It will be understood by those skilled in the art that the bead 60, 61 could be formed in any manner which causes the edge of the bead to be thicker than the remainder of the web. In addition, the bead may have any other cross-sectional shape (e.g. square or diamond), or be any other feature which provides transverse engagement, such as hooks, dovetail grooves, or the like.

Figure 8:
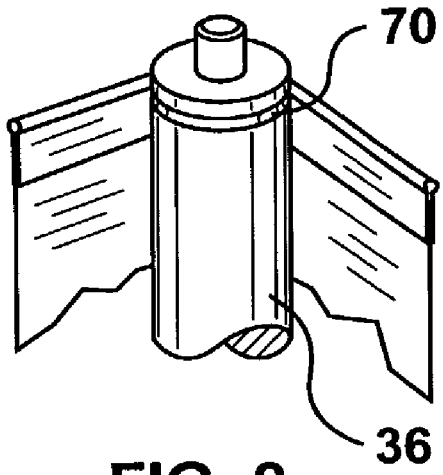
FIG. 8 is a partial perspective view of the preferred embodiment showing a portion of a roller and web.

Referring to FIG. 8, a first circumferential groove 70 located proximate to each end of each roller (for convenience, only roller 36 is shown). Preferably, a second groove is located proximate to the other end of each roller 34, 36. The second groove is identical to the first groove 70, and, accordingly, is not shown. Each groove 70 is shaped to receive the corresponding bead (for convenience, only bead 60 is shown) of the web 50. The grooves 70 provide better guidance for the web 50 during scrolling movement, while reducing the wear and tear on the bead from the rollers 34, 36.

Referring again to FIGS. 2–4, a plurality of elongate guide members 80 are connected to the housing 22 substantially adjacent to the path of travel of the longitudinal edges 58, 59 of the web 50.

Figure 10:
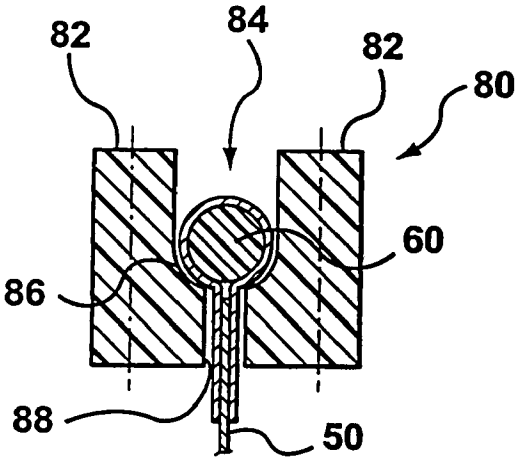
FIG. 10 is a partial cross-sectional view of the preferred embodiment showing the bead received in the guide member.
Figure 9:
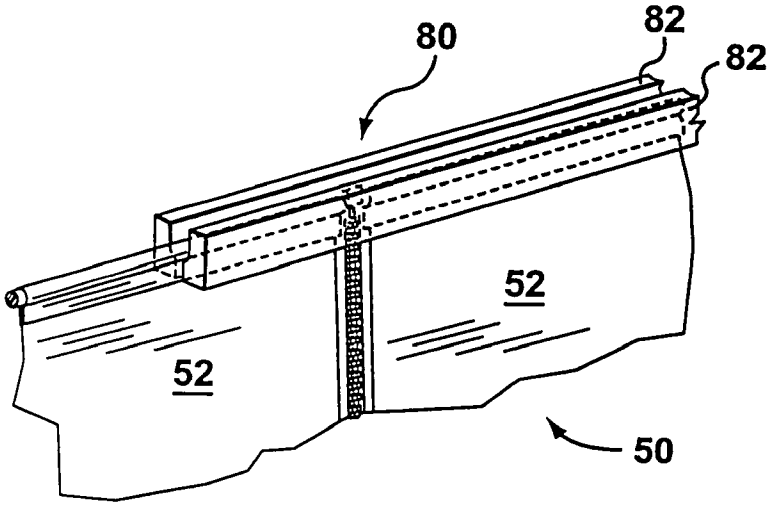
FIG. 9 is a partial perspective view of the preferred embodiment showing the guide member.
Figure 12:
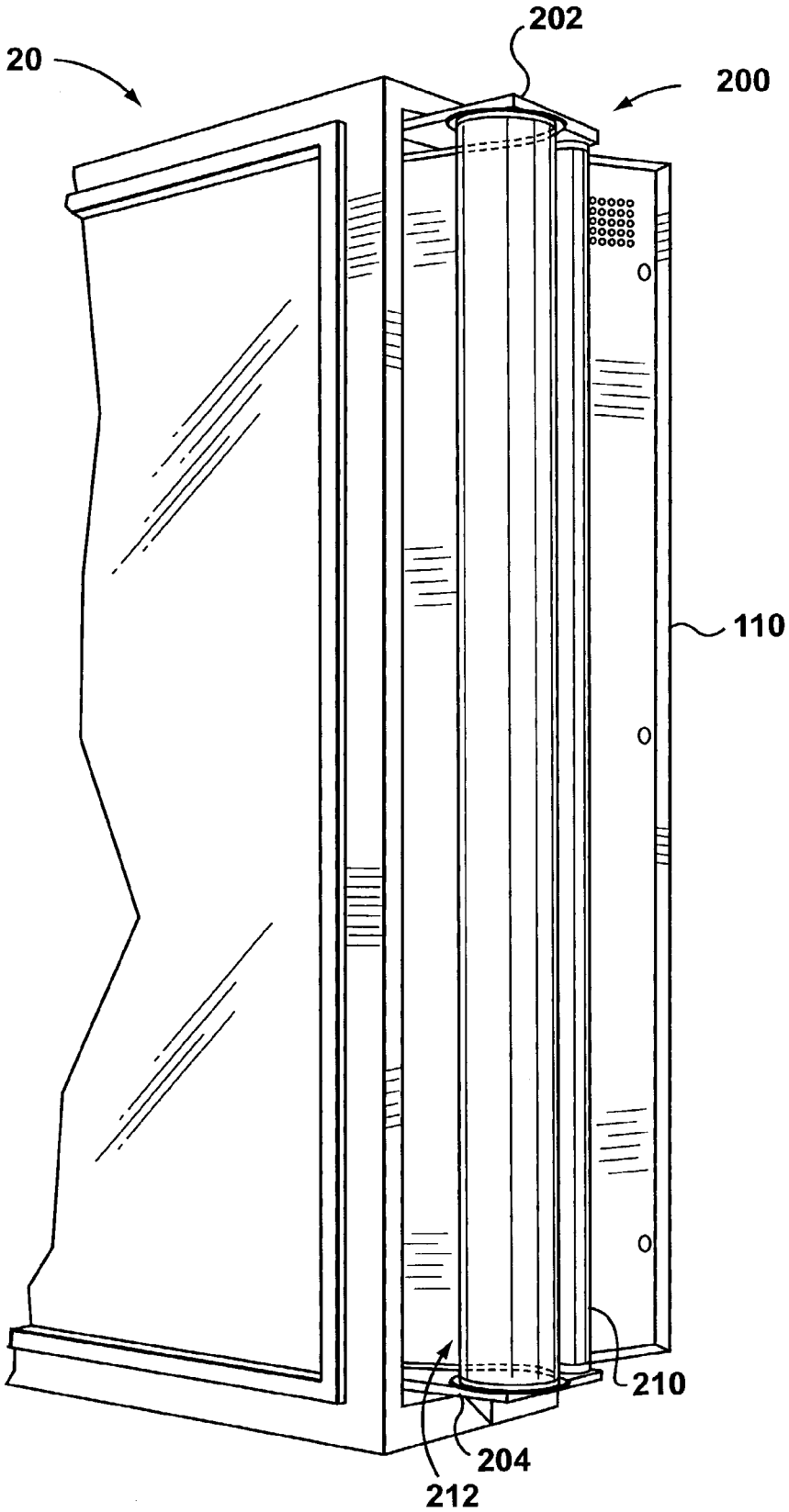
FIG. 12 is a perspective view showing an apparatus for replacing signs in the web according to an alternative embodiment of the invention.
Figure 13:
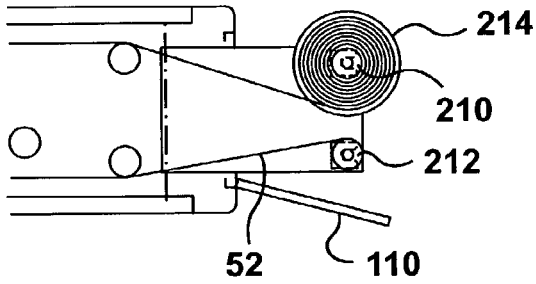
FIG. 13 is a cross-sectional view of the embodiment of FIG. 12 along line 13—13 of FIG. 14.

Referring now to FIGS. 9 and 10, the guide members 80 are preferably made up of two parallel rails 82, which together define an elongate channel 84 to receive the beads 60, 61 therein (only the guide member 80 for first bead 60 is shown for convenience, as the other guide members for second bead 61 are identical). The channel 84 is shaped to provide a seat portion 86 to retain the bead 60, and a narrow throat 88 to accommodate the web 50. Consequently, the shape of the seat portion 86 permits movement of the web 50 in the longitudinal direction, but the throat 88 retains the web 50 in the transverse direction.

In the case of a horizontally scrolling sign, it will be understood by those skilled in the art that the web 50 may only be supported at the top with the transverse tension at the bottom being provided by the force of gravity. In this alternative embodiment, no bead 61 is needed at the bottom edge of the web 50, and accordingly, the corresponding guide members along the bottom edge of the web 50 are also not needed.

Figure 11:
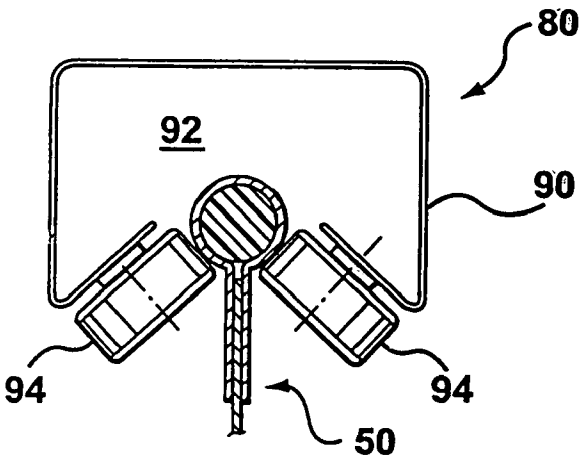
FIG. 11 is a partial cross-sectional view showing an alternative embodiment of the guide member.

FIG. 11 shows the guide member 80 according to an alternative embodiment of the invention. In this embodiment, the guide member 80 includes an elongate bracket 90 which defines a space 92 therein to receive each bead (only bead 60 is shown). Opposing pairs of bearings 94 are periodically spaced along the length of the bracket 90 to permit longitudinal travel of the beads 60, 61. The distance between the bearings is narrower than the width of the beads, thereby retaining the bead 60 in the transverse direction. The bearings provide the advantage of permitting longitudinal movement of the web 50 with reduced friction. It will be understood by those skilled in the art that any other suitable retaining member which restricts movement of the web in the transverse direction while permitting movement in the longitudinal direction may be provided.

Referring again to FIGS. 1, 2 and 4, a pressurizing means is provided in the apparatus 20. Preferably, the pressurizing means is a fan 100. The fan 100 provides several advantages. The fan 100 creates a positive (i.e. greater than atmospheric) pressure in the interior of the apparatus 20. This pressure forces the cover 26 to bow outwardly (best shown in FIG. 2) away from the web 50. For large signs, with dimensions of several meters, the cover 26 may bow outwardly by about 6 inches. Consequently, the contact between the web 50 and the cover 26 is reduced, which provides improved movement of the web 50 and reduces wear and tear on the signs 52. In addition, the fan 100 cools the apparatus 20 so that it can continue to function optimally in hot weather conditions.

Referring to FIG. 2, an air outlet 102 is provided on a door 110 located on the opposite side of the housing 22. The outlet is sufficiently small to create positive pressure in the interior of the apparatus 20.

Referring again to FIGS. 2 and 3, the door 110 is provided to permit access to the interior of the apparatus 20. The access is desirable to allow removal and replacement of signs 52.

Referring now to FIGS. 12–15, an apparatus 200 for replacement of signs 52 may be provided according to an alternative embodiment of the invention. In this embodiment, top and bottom flat access plates 202, 204, respectively are hinged to each end of the housing 22 proximate to the door 110. The access plates 202, 204 are stored in the interior of the housing 22 when not in use (as shown in dashed lines in FIG. 14), and rotate outwardly to receive first and second replacement rollers 210, 212, respectively. The bottom plate 204 may include a castor 206.

Continuing to refer to FIGS. 12–15, a replacement sign 214 is wound around the first replacement roller 210. The first and second replacement rollers 210, 212 locate into corresponding openings (not shown) in the access plates 202, 204.

The operation of the present invention will now be described. Referring to FIGS. 3–5 the electrical motor 38 turns the rollers 34 to continuously scroll the web 50 in a single direction. The control system (not shown) utilizes the sensor 39 to determine when the sign 52 is aligned in a viewing position in the window 26. Preferably, a piece of metal tape (not shown) which triggers the sensor is placed at appropriate points on the web 50. When the sensor 39 is triggered, the web 50 is stopped for a predetermined period of time. After the predetermined period of time expires, the next sign 52 is scrolled into viewing position in the same fashion. In this manner, the apparatus 20 continuously scrolls through all of the four signs 52 in the web 50.

Referring to FIGS. 9–11, the combination of the beads 60, 61 and guide members 80, maintains the web 50 tension in the transverse direction. This is particularly advantageous for larger signs, where alignment and scrolling of the web 50 becomes more difficult.

The replacement of signs 52 for the web 50 will now be described. Referring to FIG. 3, the electric motor 38 is turned off to stop the movement of the web 50. The door 110 is opened to provide access to the interior of the apparatus 20. The tension release mechanism 35 is released to reduce the longitudinal tension in the web 50.

Figure 14:
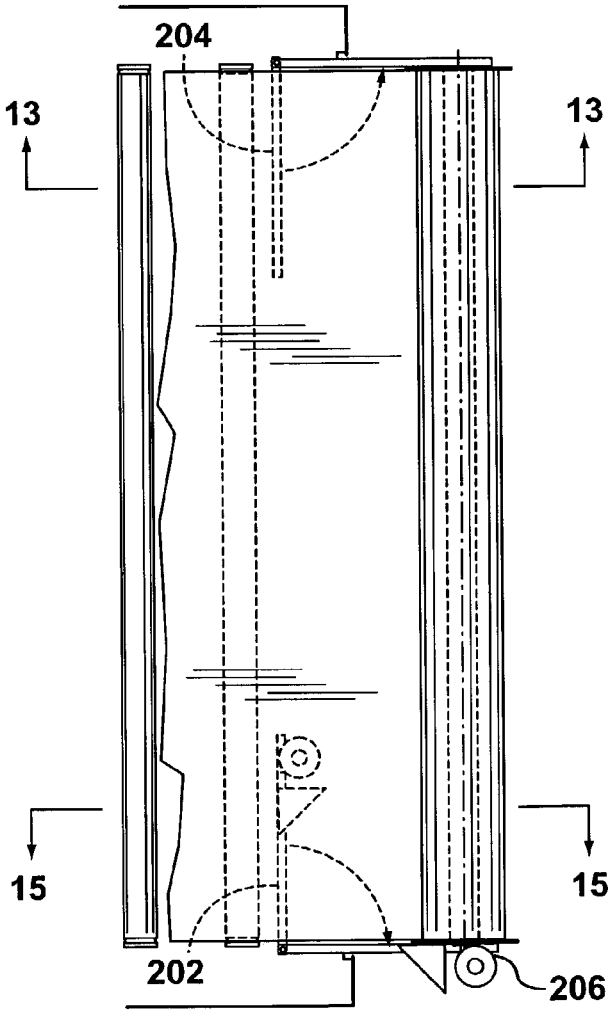
FIG. 14 is a side view of the embodiment of FIG. 12.
Figure 15:
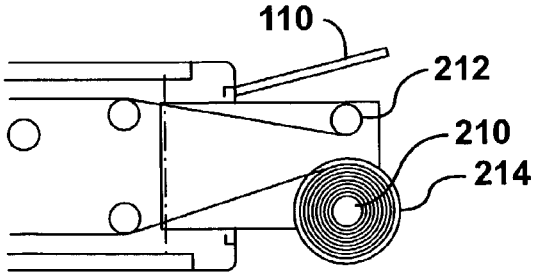
FIG. 15 is a cross-sectional view of the embodiment of FIG. 12 along line 15—15 of FIG. 14.

Referring now to FIG. 14, the access plates 204, 206 are rotated from the position shown in dashed lines to the position shown in solid lines.

Referring to FIGS. 12–15, the replacement rollers 210, 212 are fitted onto the access plates 204, 206 and positioned transverse to the web 50. A selected sign 52 is unzipped from the web 50 along a first side thereof and attached to the second replacement roller 212. The replacement sign 214 is zipped onto the web 50 along a first side thereof. The second replacement roller 212 is rotated to roll the sign 52 thereon. At the same time the rotation of the second replacement 212 roller pulls the web 50, causing the replacement sign 214 to unroll from the first replacement roller 212. When the selected sign 52 is rolled onto the second replacement roller 212, the second side of the selected sign is unzipped from the web 50 and the second side of the replacement sign 214 is zipped onto the web 50, completing the replacement. The above replacement apparatus 200 provides improved ease in replacing signs in the web 50.

While the present invention as herein shown and described in detail is fully capable of attaining the above-described objects of the invention, it is to be understood that it is the presently preferred embodiment of the present invention and thus, is representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural and functional equivalents to the elements of the above-described preferred embodiment that are known or later come to be known to those of ordinary skill in the art are expressly incorporated herein by reference and are intended to be encompassed by the present claims. Moreover, it is not necessary for a device or method to address each and every problem sought to be solved by the present invention, for it is to be encompassed by the present claims.

The invention claimed is:

1. An apparatus comprising:

a) a plurality of sign sheets connected in an endless loop to form a web, wherein a leading edge of each of said sign sheets is connected to a trailing edge of an adjacent one of said sign sheets;

b) a housing, said housing defining a window for displaying said plurality of sign sheets;

c) a plurality of rollers located in said housing, said rollers being adapted for advancing said web through said window;

d) a flexible cover covering said window, said cover being adapted to permit viewing of said sign sheets therethrough; said cover and said housing defining an enclosure, said web being located in said enclosure; and e) a fan adapted to produce an internal pressure in said enclosure, wherein said internal pressure is sufficient to urge said cover away from said web.

2. The apparatus of claim 1, wherein said fan is located on said housing.

3. The apparatus of claim 1, further comprising:

a) a first replacement roller adapted for storing a replacement sign, said replacement sign being adapted for connection to said web;

b) a second replacement roller adapted to receive a selected sign thereon for removal from said web;

wherein said second replacement roller being adapted to move said web to wind said selected sign onto said second replacement roller.

4. The apparatus of claim 3, wherein said first and second replacement rollers are operatively connected to said housing.

5. The apparatus of claim 4, wherein said apparatus further comprises top and bottom access plates, said top and bottom access plates being rotatably connected to a side of said housing, wherein said top and bottom access plates being adapted to receive said first and second replacement rollers therebetween.

6. The apparatus of claim 5, wherein said top and bottom access plates are each movable between a storage position within said housing and an operating position outside said housing.

* * * * *